United States Patent [19]

Koike et al.

[11] Patent Number: 4,640,244

[45] Date of Patent: Feb. 3, 1987

[54] IDLING SPEED FEEDBACK CONTROL METHOD FOR INTERNAL COMBUSTION ENGINES

[75] Inventors: Yuzuru Koike; Akihiko Koike, both of Utsunomiya; Masayuki Ueno, Haga, all of Japan

[73] Assignee: Honda Giken Kogyo Kabushiki Kaisha, Tokyo, Japan

[21] Appl. No.: 780,559

[22] Filed: Sep. 26, 1985

[30] Foreign Application Priority Data

Sep. 28, 1984 [JP] Japan ..... 59-201589

[51] Int. Cl.[4] ..... F02D 41/16; F02M 3/07

[52] U.S. Cl. ..... 123/339; 123/585

[58] Field of Search ..... 123/339, 585

[56] References Cited

U.S. PATENT DOCUMENTS 4,467,761 8/1984 Hasegawa ..... 123/339

4,491,108 1/1985 Hasegawa et al. ..... 123/339

FOREIGN PATENT DOCUMENTS 98628 7/1980 Japan .

167833 10/1983 Japan ..... 123/339

*Primary Examiner*—Tony M. Argenbright

*Attorney, Agent, or Firm*—Lyon & Lyon

[57] ABSTRACT

An idling speed feedback control method for an internal combustion engine for controlling the operating amount of a control valve for regulating the quantity of intake air being supplied to the engine in response to the difference between a desired idling speed and an actual engine speed, while the engine is in a predetermined idling region. A correction value for the operating amount of the control valve is determined in dependence upon the valve of a signal indicative of generating conditions of a generator driven by the engine for supplying electric power to at least one electrical device, and the operating amount of the control valve is corrected by means of the thus determined correction value. When the engine has entered the predetermined idling region immediately following deceleration, an initial value of the operating amount of the control valve which is applied at the start of the feedback control is set to a sum of a value obtained by correcting the correction value by means of a predetermined increment, and a predetermined reference value. While the engine is decelerating toward the predetermined idling region, the operating amount of the control valve is set to a value equal to the initial value.

7 Claims, 6 Drawing Figures

70
WAS PRECEDING LOOP IN FEEDBACK MODE ?
No
Yes
72
DAIn-1 = DAIn-1
71
DAIn-1 = DXREF + DE·XAIC
73
ΔMn = Me − MH
74
ΔDI = KI ΔMn
Dp = Kp ΔMn
75
DETERMINE ΔDE
76
DAIn = DAIn-1 + ΔDI + ΔDE
77
DOUT = DAIn + Dp
78
CALCULATE DXREF

IDLING SPEED FEEDBACK CONTROL METHOD FOR INTERNAL COMBUSTION ENGINES

BACKGROUND OF THE INVENTION

This invention relates to an idling speed feedback control method for internal combustion engines, and more particularly to a method of this kind which is adapted to control the intake air quantity in dependence upon the magnitude of electrical loads on the engine so as to eliminate a lag in the feedback control of the idling speed, at the start of the same control immediately following deceleration of the engine.

A conventional idling speed feedback control method has been known e.g. from Japanese Patent Provisional Publication (Kokai) No. 55-98628, which comprises setting the desired idling speed in dependence upon load on the engine at engine idle, detecting the difference between the desired idling speed and the actual engine speed, and supplying the engine with supplementary air in a quantity corresponding to the detected difference so as to minimize the same difference, to thereby control the engine speed to the desired idling speed.

In the above conventional method, if one or more electrical devices such as head lamps and a radiator cooling fan in a vehicle equipped with the engine are operated at the start of idling speed feedback control (hereinafter merely called "feedback control"), the generator has to function to supply electric power to the electrical devices, causing increased load on the engine and a consequent drop in the engine speed. Such a drop in the engine speed which is caused, particularly at the start of the feedback control immediately following deceleration of the engine, can lead to engine stall upon an increase in the engine load.

In order to overcome such inconvenience, the present assignee has previously proposed an engine speed control method in Japanese Provisional Patent Publication (Kokai) No. 58-197449, which is adapted to detect the on-off state of each one of a plurality of electrical devices, and simultaneously with detection of the on-state of the each device, increase the valve opening period of a control valve for regulating the amount of supplementary air over a predetermined period of time corresponding to the magnitude of electrical load of the each electrical device that is detected to be in the on-state, so as to minimize a lag in control of the supplementary air amount, thereby improving the driveability of the engine.

However, in recent years, various kinds of electrical devices have been installed in a vehicle equipped with an engine so as to improve the driveability of the engine and ensure safety running of the vehicle, which makes it necessary to provide as many sensors and input devices as the electrical devices for detection of the on-off sate of each one of the electrical devices, storing predetermined valve opening values for the supplementary air amount-controlling valve each corresponding to the electrical load of the each electrical device into memory means of the control system, etc., thus making the control program complicated and also increasing the memory capacity of the control system, resulting in disadvantages such as increased manufacturing cost of the control system.

SUMMARY OF THE INVENTION

It is an object of the present invention to provide an idling speed control method for an internal combustion engine, which can supply intake air to the engine in a required quantity depending upon the magnitude of electrical load applied on the engine by at least one electrical device, without control lag, when the engine is decelerated to enter an idling speed feedback control region, to thereby achieve stable rotation of the engine.

It is another object of the present invention to provide an idling speed control method for an internal combustion engine, which can accurately control the idling speed in a feedback manner responsive to changes in the magnitude of electrical load applied on the engine, without causing complication of the control program and increase in the memory capacity of the control system.

The present invention provides a method of controlling the operating amount of a control valve for regulating the quantity of intake air being supplied to an internal combustion engine, in a feedback manner responsive to the difference between a desired idling speed and an actual engine speed while the engine is in a predetermined idling region, the engine having a generator driven thereby for supplying electric power to at least one electrical device in dependence upon operative states of the electrical device.

The method is characterized by comprising the following steps: (1) detecting the value of a signal indicative of generating conditions of the generator; (2) determining a correction value for the operating amount of the control valve in dependence upon the value of the signal thus detected; (3) correcting the operating amount of the control valve by means of the correction value thus determined; and (4) setting an initial value of the operating amount of the control valve which is applied at the start of the feedback control to a sum of a value obtained by correcting the correction value by a predetermined increment, and a predetermined reference value, when the engine has entered the predetermined idling region immediately after deceleration thereof.

Preferably, when the engine is in a predetermined decelerating region wherein it is decelerating toward the predetermined idling region, the operating amount of the control valve is set to a value equal to the initial value thereof applicable at the start of the feedback control, and the engine is supplied with intake air through the control valve in a quantity corresponding to the operating amount of the control valve thus set while the engine is in the predetermined decelerating region.

Preferably, the value of the signal indicative of generating conditions of the generator is proportionate to the magnitude of field current supplied to the generator.

The above and other objects, features and advantages of the invention will be more apparent from the ensuing detailed description taken in conjunction with the accompanying drawings.

DETAILED DESCRIPTION

The method of the invention will now be described in detail with reference to the accompanying drawings.

Figure 1:
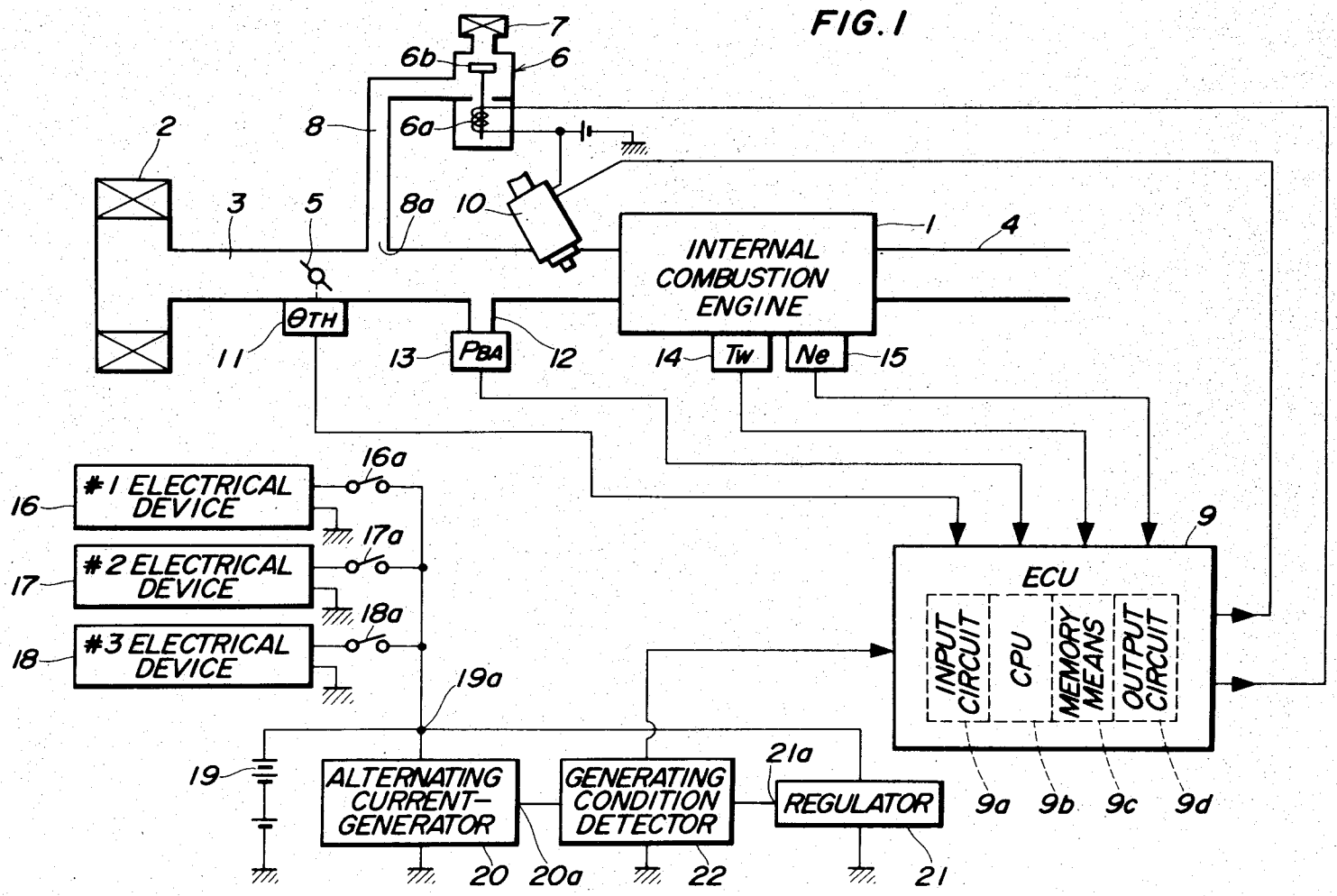
FIG. 1 is a block diagram illustrating the whole arrangement of an idling speed feedback control system of an internal combustion engine, to which the method of the invention is applied.

Referring first to FIG. 1, an engine speed control system of an internal combustion engine for use in a vehicle is schematically illustrated, to which is applied the method of the invention. Reference numeral 1 designates an internal combustion engine which may be a four-cylinder type, and to which are connected an intake pipe 3 with an air cleaner 2 mounted at its open end and an exhaust pipe 4, at an intake side and an exhaust side of the engine 1, respectively. A throttle valve 5 is arranged within the intake pipe 3, and an air passage 8 opens at its one end 8*a* in the intake pipe 3 at a location downstream of the throttle valve 5. The air passage 8 has its other end communicating with the atmosphere and provided with an air cleaner 7. A supplementary air quantity control valve (hereinafter merely called "the control valve") 6 is arranged across the air passage 8 to control the quantity of supplementary air being supplied to the engine 1 through the air passage 8 and the intake pipe 3. This control valve 6 is a normally closed type solenoid-controlled valve, and comprises a solenoid 6*a* and a valve 6*b* disposed to open the air passage 8 when the solenoid 6*a* is energized. The solenoid 6*a* is electrically connected to an electronic control unit (hereinafter called "the ECU") 9.

Fuel injection valves 10 are arranged in a manner projected into the intake pipe 3 at locations between the engine 1 and the open end 8*a* of the air passage 8, and are connected to a fuel pump, not shown, and also electrically connected to the ECU 9.

A throttle valve opening ($\theta$th) sensor 11 is mounted on the throttle valve 5, and an intake pipe absolute pressure (PBA) sensor 13 is provided in communication with the intake pipe 3 through a conduit 12 at a location downstream of the open end 8*a* of the air passage 8, while an engine cooling water temperature (TW) sensor 14 and an engine crank angle position (Ne) sensor 15 are both mounted on the main body of the engine 1. All the sensors are electrically connected to the ECU 9.

Reference numerals 16, 17 and 18 represent first, second and third electrical devices, such as head lamps, a radiator cooling fan, and a heater fan, each of which has one terminal connected to a junction 19*a* through switches 16*a*, 17*a* and 18*a*, respectively, and the other terminal grounded. A battery 19 of the engine 1, an alternating current-generator 20 of same, and a regulator 21 for suppliying field current to the generator 20 in response to electrical loads produced by the electrical devices 16–18 are connected to the junction 19*a* in series at respective one terminals, and are grounded at respective other terminals. The regulator 21 has its field current output terminal 21*a* connected to a field current input terminal 20*a* of the generator 20 through a generating condition detector 22. The generating condition detector 22 is electrically connected to the ECU 9 for supplying same with a signal indicative of generating conditions of the generator 20, for instance, a signal E having a voltage level corresponding to the magnitude of the field current being supplied from the regulator 21 to the generator 20.

The generator 20 is mechanically connected to an output shaft, not shown, of the engine 1 to be driven by same. When each of the switches 16*a*, 17*a*, and 18*a* of the electrical devices 16, 17, and 18 is closed, the generator supplies electric power to the each device that is in the on-state. When the operation of the each device in the on-state requires electric power in excess of the generating capacity of the generator 20, the battery 19 operates to compensate for the power shortage.

The ECU 9 comprises an input circuit 9*a* having functions of shaping waveforms of pulses of input signals from the aforementioned sensors, shifting voltage levels of the input signals, and converting analog values of the input signals into digital signals, etc., a central processing unit (hereinafter called "the CPU") 9*b*, memory means 9*c* for storing various control programs executed within the CPU 9*b* as well as various calculated data from the CPU 9*b*, and an output circuit 9*d* for supplying driving signals to the fuel injection valves 10 and the control valve 6.

Engine operation parameter signals from the throttle valve opening sensor 11, the absolute pressure sensor 13, the engine cooling water temperature sensor 14, and the engine crank angle position sensor 15 as well as the signal indicative of the generating conditions of the generator 20 are supplied to the CPU 9*b* through the input circuit 9*a* of the ECU 9. Then, the CPU 9*b* determines operating conditions of the engine 1 and engine load conditions such as electrical loads on same on the basis of the read values of these engine operation parameter signals as well as the signal indicative of the generating conditions of the generator 20, and then calculates the desired idling speed at idling of the engine 1, a desired quantity of fuel to be supplied to the engine 1, that is, a desired valve opening period TOUT of the fuel injection valves 10, and also a desired quantity of supplementary air to be supplied to the engine 1, that is, a desired valve opening duty ratio DOUT of the control valve 6, on the basis of the determined engine operating conditions, etc. Then the CPU 9*b* supplies driving signal pulses corresponding to the calculated values TOUT and DOUT to the fuel injection valves 10 and the control valve 6, respectively, through the output circuit 9*d*.

The control valve 6 has its solenoid 6*a* energized by each of its driving pulses to open the air passage 8 for a period of time corresponding to its calculated valve opening duty ratio DOUT so that a required quantity of supplementary air corresponding to the calculated valve opening duty ratio DOUT is supplied to the engine 1 through the air intake passage 8 and the intake pipe 3.

The fuel injection valves 10 are each energized by each of its respective driving pulses to open for a period of time corresponding to its calculated valve opening period value TOUT to inject fuel into the intake pipe 3, so as to supply an air-fuel mixture having a required air-fuel ratio to the engine 1.

When the valve opening period of the control valve 6 is increased to increase the quantity of supplementary air, an increased quantity of the mixture is supplied to the engine 1 to increase the engine output, resulting in an increase in the engine speed, whereas a decrease in the valve opening period causes a corresponding decrease in the quantity of the mixture, resulting in a decrease in the engine speed. In this manner, the engine speed during idling of the engine is controlled by controlling the supply quantity of supplementary air or the valve opening period of the control valve 6.

Figure 2:
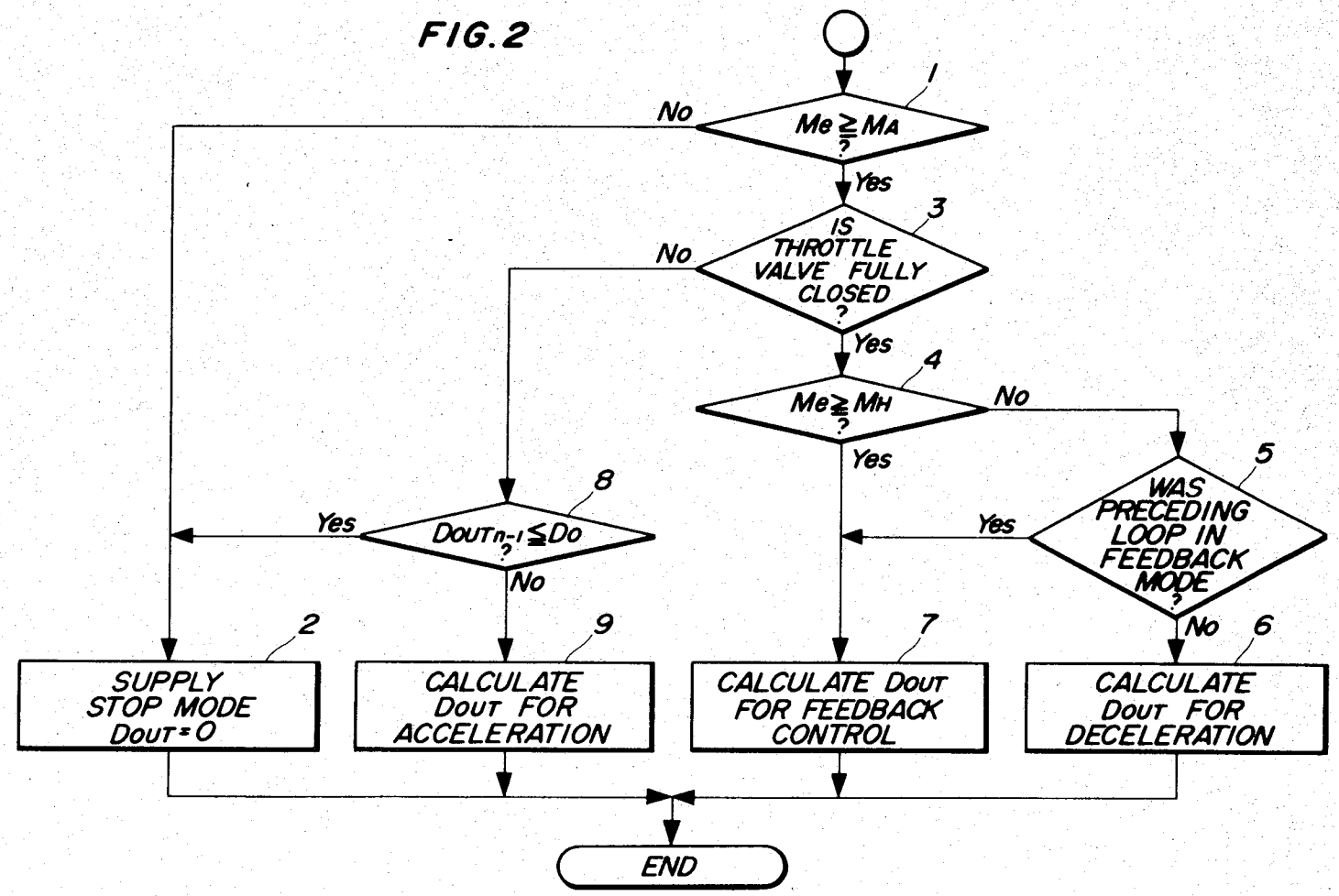
FIG. 2 is a flow chart showing a manner of calculating the valve opening duty ratio DOUT of a control valve for regulating the quantity of supplementary air, which is executed within the electronic control unit (ECU) in FIG. 1.

FIG. 2 shows a manner of calculating the valve opening duty ratio DOUT of the control valve 6, which is executed within the CPU 9*b* of the ECU 9 in FIG. 1 in synchronism with pulses of a signal each generated at a predetermined crank angle of the engine from the Ne sensor 15 (hereinafter called "the TDC signal").

First, it is determined at the step 1 whether or not a value Me corresponding to the reciprocal of the engine speed Ne is larger than a value MA corresponding to the reciprocal of a predetermined value NA (e.g. 1500 rpm). If the answer is no (i.e. if the relationship of $Me \geqq MA$ is not satisfied), that is, if the engine speed Ne is higher than the predetermined value NA, the valve opening duty ratio DOUT is set to zero, at the step 2, since the supply of supplementary air to the engine is then unnecessary. This control mode in which the valve opening duty ratio DOUT is set to zero in order to fully close the control valve is hereinafter referred to as "the supply stop mode".

On the other hand, if the answer at the step 1 is yes (i.e. if the relationship of $Me \geqq MA$ is satisfied), that is, if the engine speed Ne is smaller than the predetermined value NA, whether or not the throttle valve 5 is then substantially fully closed is determined at the step 3. If the throttle valve 5 is substantially fully closed, whether or not the value Me is larger than a value MH corresponding to the reciprocal of a predetermined upper limit value NH of a desired idling speed range is determined, at the step 4. If the answer at the step 4 is no, that is, if the engine speed Ne is higher than the predetermined upper limit value NH of the desired idling speed range, as hereinafter explained in detail, in step 5 it is determined whether or not the preceding loop was in feedback mode. If the answer at the step 5 is negative, then the program proceeds to the step 6 wherein the valve opening duty raito DOUT of the control valve 6 is calculated for decelerating mode control.

The valve opening duty ratio DOUT applied during decelerating mode control is calculated by the following equation:

$$DOUT = DXREF \times DE \cdot XAIC \quad (1)$$

wherein DXREF represents a reference value for setting an initial value of the valve opening duty ratio DOUT applicable at the start of feedback mode control, described later, which is set at a mean value of the valve opening duty ratios applied during the past feedback control while all the electrical devices 16–18 are in off-state, in a calculation manner hereinafter explained with reference to FIG. 3. DE represents an electrical load-dependent correction value depending upon the magnitude of field current supplied to the generator 20 for supplying electric power to the electrical devices 16–18, while XAIC is an air increasing coefficient according to the invention, which is set to a value larger than 1.0 (e.g. 2.0).

The ECU 9 supplies the control valve 6 with a driving signal having a pulse duration corresponding to the valve opening duty ratio DOUT calculated by the equation (1), so that supplementary air is supplied to the engine 1 in a quantity corresponding the calculated duty ratio DOUT through the control valve 6. Thus, the engine 1 is supplied beforehand with supplementary air in a quantity determined in decelerating mode control from the time the engine speed Ne decreases below the predetermined value NA to the time it further decreases to the upper limit value NH of the desired idling speed range and feedback mode control, hereinafter described, is started. By virtue of this control manner, the operation of the engine can be smoothly shifted from the decelerating region into the idling speed feedback control region, without causing a large drop in the engine speed below the desired idling speed. Further, by employing the mean value DXREF of the valve opening duty ratio values applied during the past feedback mode control as the reference value for setting the initial value of the valve opening duty ratio DOUT applicable at the start of the present feedback mode control, it can be prevented that the actual supplementary air quantity deviates from a required value corresponding to the calculated desired DOUT value, due to variations in the operating characteristics of the control valve 6 between different production lots, degradation in the performance of the same valve per se, and/or aging change in the degree of clogging of the air filter 7.

When the engine speed Ne decreases so that the answer to the question of the step 4 becomes yes (i.e. if the relationship of $Me \geqq MH$ is satisfied), that is, the engine speed Ne becomes lower than the predetermined upper limit value NH of the desired idling speed range, thereby the engine operation shifting into the feedback mode control region, the program proceeds to the step 7 to calculate the valve opening duty ratio DOUT for feedback mode control.

The valve opening duty ratio DOUT applied during feedback mode control is calculated by the following equation:

$$DOUT = DAIn + DP \quad (2)$$

wherein the duty ratio DOUT is expressed as a sum of an integral control term DAIn and a proportional control term DP. The present value of the integral control term DAIn is set to a sum value obtained by adding to a value thereof DAIn−1 obtained during the immediately preceding control loop a correction value ΔDI dependent upon the difference between the actual engine speed and the desired idling speed, and a correction value ΔDE dependent upon a change in the magnitude of electrical load, described later in detail with reference to FIG. 4 (i.e. $DAIn = DAIn-1 + \Delta DI + \Delta DE$).

Figure 3:
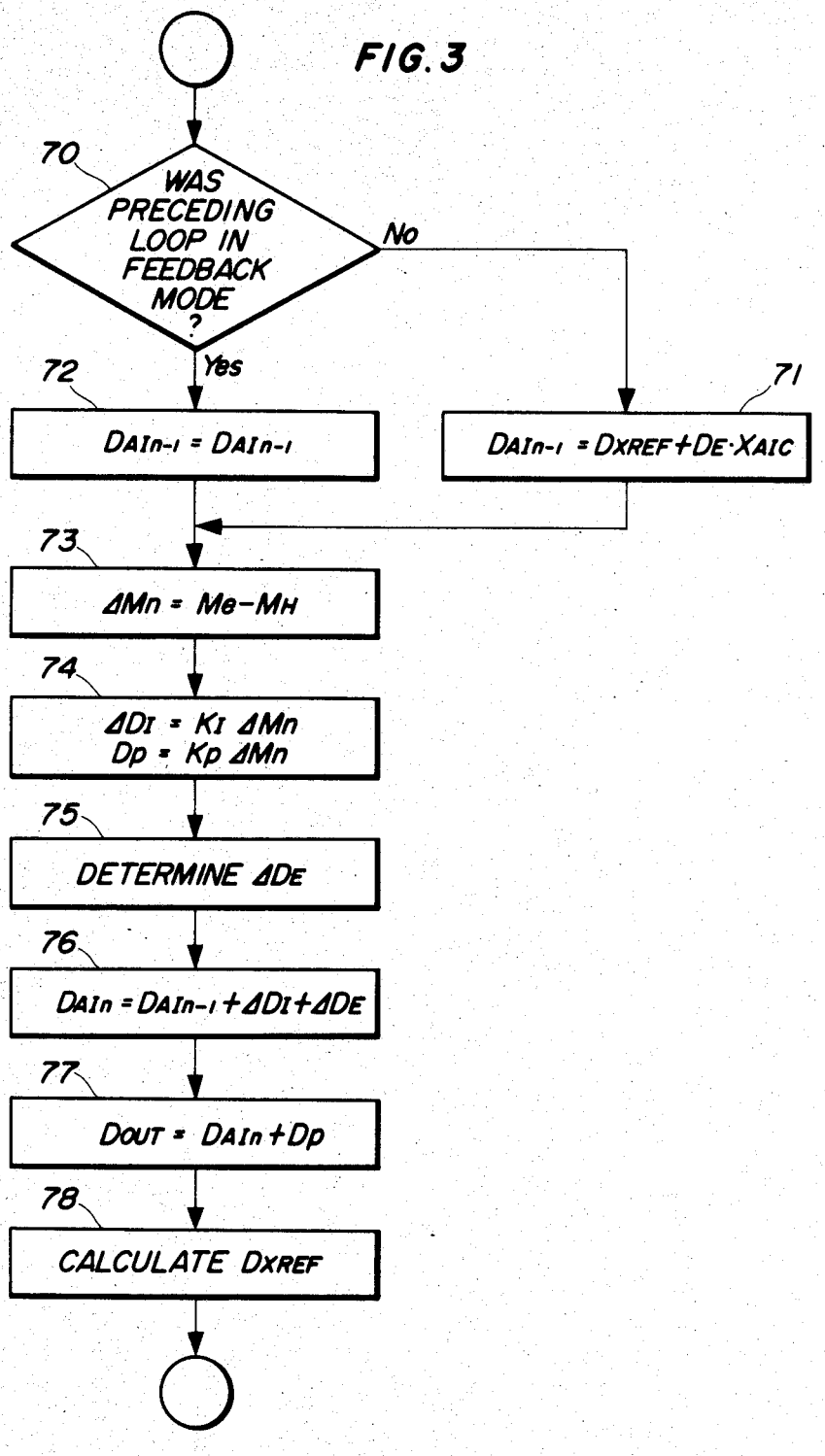
FIG. 3 is a flow chart showing a manner of calculating the valve opening duty ratio DOUT of the control valve applied during feedback mode control of the supplementary air quantity.

FIG. 3 shows a manner of calculating the valve opening duty ratio DOUT in feedback mode control, which is executed at the step 7 in FIG. 2.

First, at the step 70, it is determined whether or not feedback mode control of the idling speed was effected in the preceding loop executed in synchronism with an immediately preceding TDC signal pulse. If the answer at the step 7 is no, that is, if the preceding loop was in decelerating control mode, the step 71 is executed to set the integral control term DAIn−1 as an initial value which is applicable at the start of feedback mode control to a value equal to the valve opening duty ratio (DXREF+DE·XAIC) obtained in the last loop. On the other hand, if the answer at the step 7 is yes, that is, if the preceding loop was in feedback control mode, the integral control term DAIn−1 is set to a value thereof obtained in the preceding loop, at the step 72.

After the value of the integral control term DAIn−1 having been thus set at the step 71 or 72, the program proceeds to the step 73 to calculate the difference between the actual engine speed Ne and the upper limit value NH of the desired idling speed range. In practice, the difference is calculated from the difference ΔMn between the value Me corresponding to the reciprocal of the actual engine speed Ne and the value MH corresponding to the reciprocal of the upper limit value NH.

Then, at the step 74, a correction value ΔDI for the integral control term DAIn−1 is calculated by multiplying the above difference ΔMn by a constant KI, and at the same time the proportional control term DP is calculated by multiplying the difference ΔMn by a constant KP. Then, at the step 75, the correction value ΔDE is calculated in dependence upon the difference between a value DEn−1 of the electrical load-dependent correction value DE obtained in the preceding loop and a value DEn of same in the present loop.

Figure 4:
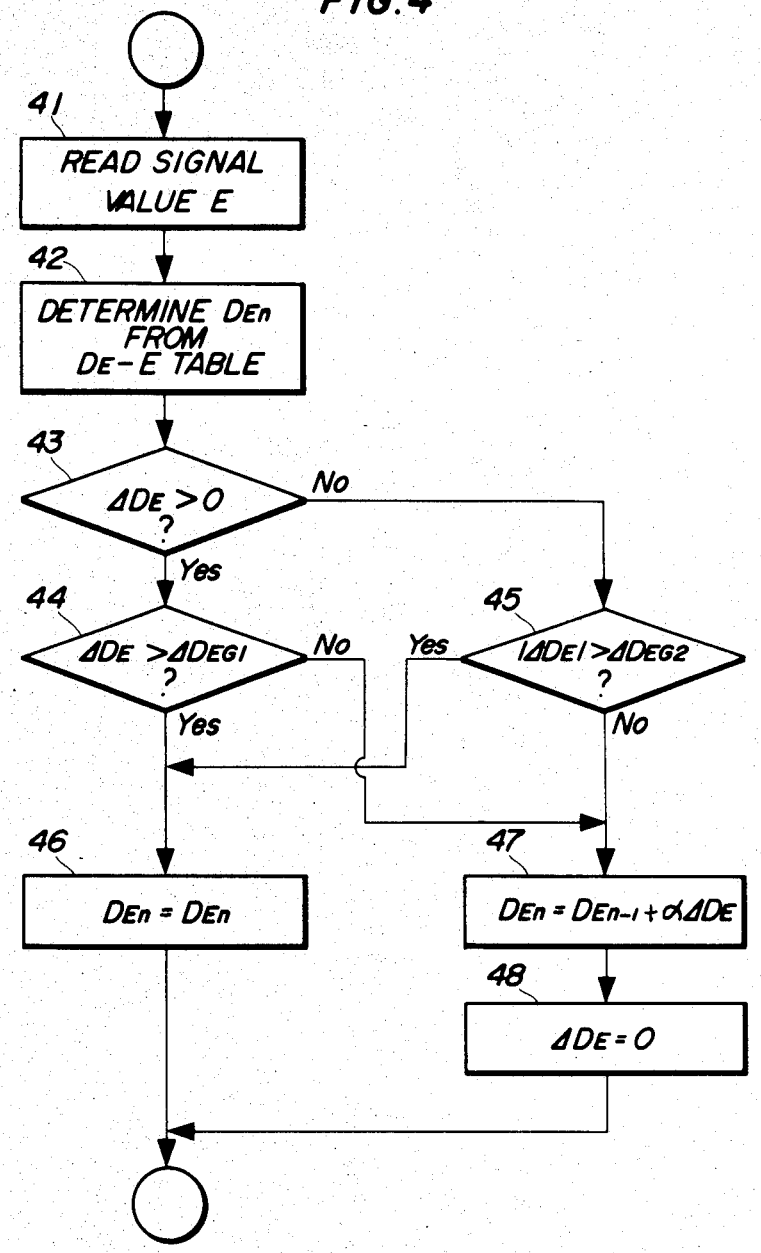
FIG. 4 is a flow chart showing a manner of calculating an electrical load-dependent correction value DE and a correction value DE of the valve opening period DOUT of the control valve.
Figure 5:
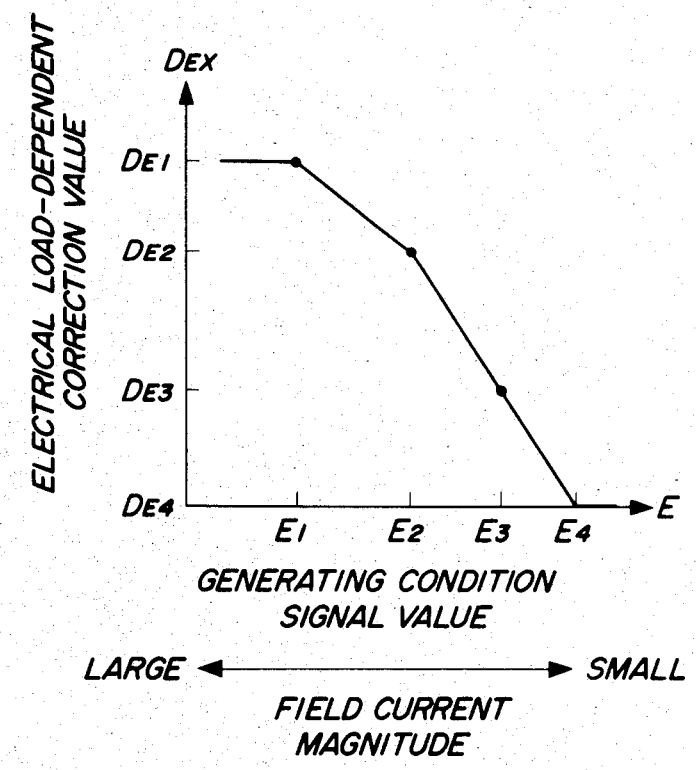
FIG. 5 is a graph showing a table of the relationship between a signal value E indicative of generating conditions of the generator and the electrical load-dependent correction value DE.

FIG. 4 shows a manner of calculating the electrical load-dependent correction value DE and the correction value ΔDE. At the step 41, the signal value E supplied from the generating condition detector 22 (FIG. 1) is read, which corresponds to the magnitude of the field current being supplied to the generator 20. Then, at the step 42, a value DEn of the electrical load-dependent correction value DE for the calculation of the valve opening duty ratio DOUT is determined from the signal value E read from a table of the relationship between the electrical load-dependent correction value DE and the generating condition signal value E shown in FIG. 5. In FIG. 5, four different generating condition signal values E1 (e.g. 1 V), E2 (e.g. 2 V), E3 (e.g. 3 V), and E4 (e.g. 4.5 V) are provided, while four different electrical load-dependent correction values DE1 (e.g. 50%), DE2 (e.g. 30%), DE3 (e.g. 10%), and DE4 (e.g. 0%) are provided, each of which corresponds to respective one of the values E1–E4. When the signal value E read at the step 41 falls between two adjacent ones of the provided signal values E1–E4, the value DEn of the electrical load-dependent correction value DE is calculated by an interpolation method. The value DEn of the electrical load-dependent correction value DE determined in correspondence to the read signal value E by the use of the DE - E table shown in FIG. 5 is set at a value which is smaller than a value DE′ of the electrical load-dependent correction value DE sufficient for supplying supplementary air in a quantity required for compensation for a change in the magnitude of electrical load so as to maintain the engine speed unchanged, but which is, at the same time, sufficient for preventing a sudden drop in the engine speed as well as a so-called phenomenon "blow-up" of the engine. For example, the value DEn is set at a value 0.5 times as large as the above value DE′.

Next, the program proceeds to the step 43 wherein the correction value or differnece ΔDE between the value DEn of the electrical load-dependent correction value DE obtained in the present loop and the value DEn−1 obtained in the preceding loop is calculated, and it is determined whether or not the calculated difference ΔDE is larger than zero. If the difference ΔDE is larger than zero, the step 44 is executed to compare the difference ΔDE with a first predetermined value ΔDEG1 (e.g. 10%), while if the difference ΔDE is not larger than zero, the step 45 is executed to compare an absolute value |ΔDE| with a second predetermined value ΔDEG2 (e.g. 15%).

If the answer to either the steps 44 or 45 is yes, that is, if the difference ΔDE is larger than the first predetermined value ΔDEG1, or if the absolute value |ΔDE| is larger than the second predetermined value ΔDEG2, it means that the operative state of one or more of the electrical devices 16–18 has changed from the off-state to the on-state, or vice versa, to produce a relatively large change in the magnitude of electrical load on the engine 1, such that there is a fear that the engine speed can rapidly decrease or increase. Therefore, the program proceeds to the step 46 wherein the present value DEn of the electrical load-dependent correction value DE is set to the value DEn determined at the step 42, followed by termination of execution of the program of FIG. 4.

On the other hand, if the answer to either the steps 44 or 45 is no, that is, if the difference ΔDE (>0) is smaller than the first predetermined value ΔDEG1, or if the absolute value |ΔDE| (DE≦0) is smaller than the second predetermined value ΔEG2, it means that there is no fear that the engine speed rapidly changes. Therefore, the program proceeds to the step 47 to set the value DEn of the electrical load-dependent correction value DE to a value which is further smaller than the value DE′.

That is, at the step 47, the present value DEn is calculated by the following equation:

$$DEn = DEn-1 + \alpha\Delta DE \quad (3)$$

wherein α is a correction coefficient dependent on dynamic characteristics of the engine 1, and set to a value, e.g. 0.5. Incidentally, if the correction coefficient α is set to a value 1.0, the equation (3) will be DEn=DEn, the same as in the calculation at the step 46, since the difference ΔDE in the equation (3) is represented as ΔDE=DEn−DEn−1.

As stated above, the present value DEn of the electrical load-dependent correction value DE is set to a further smaller value by the use of the correction coefficient α, when the change in the magnitude of electrical load is small. Therefore, even if an electrical device such as a blinker which produces a small electrical load is repeatedly turned on and off, hunting of the idling speed can be prevented, depending on the charged condition of the battery 19. Then, at the step 48, in the event that such small change occurs in the magnitude of electrical load during feedback control of the supplementary air, it is judged that it is unnecessary to correct the present value DAIn−1 (set at the step 72 in FIG. 3) of the integral control term DAIn by means of the difference ΔDE, since the electrical load change which has occurred is small, and the difference ΔDE calculated at the step 43 is set to zero. Then, execution of the program of FIG. 4 is terminated. Setting of the difference ΔDE to zero is particularly advantageous in preventing hunting of the idling speed which can be caused in the event that the magnitude of field current supplied from the regulator changes even with no actual change in the magnitude of electrical load, resulting in a fluctuation in the signal value E. To be specific, the regulator 21 performs on-off control of the field current so as to hold the output voltage of the alternating current-generator 20 at a constant level. The generating condition detector 22 is provided with a filter circuit so as to minimize fluctuations in the signal value E due to the on-off control of the field current. However, the filter circuit of the detector 22 cannot completely eliminate fluctuations in the signal value E. If the engine is supplied with a supplementary air quantity varying in response to fluctuations in the signal value E, it will result in degraded stability of the rotation of the engine.

Incidentally, as stated above, at the step 71, the initial value of the integral control term DAIn−1 is set to a value equal to the sum of the reference value DXREF and the product DE·XAIC, wherein the product DE·XAIC is a value substantially equal to the aforementioned value DE' of the electrical load-dependent correction value DE for supplying supplementary air to the engine in a quantity required for maintaining the engine speed unchanged when there occurs a change in the generating condition signal value E, i.e. in the magnitude of electrical load on the engine.

Reverting to FIG. 3, after the difference ΔDE has been determined, the step 76 is executed to calculate the present value of the integral control term DAIn. Then, at the step 77, the valve opening duty ratio DOUT in the present loop is calculated by adding the integral control term DAIn thus calculated to the proportional control term DP, according to the equation (2). Then, the program proceeds to the step 78 to calculate the mean value DXREF of the valve opening duty ratio values DOUT which have been applied during past feedback mode control. The calculation of the mean value DXREF is executed by the following equation while all the electrical devices 16–18 are in the off-state:

$$DXREF = \frac{C}{A} \times DAIn + \frac{A-C}{A} \times DXREF'$$

where C and A are constants satisfying the relationship of $11 \leqq C < A$, DAIn is a value of the integral control term as a feedback mode control term obtained in the present loop, and DXREF' is a mean value of the valve opening duty ratio values DOUT which have been obtained until the last feedback mode control loop. The value of the constant C is set to a suitable value within a range satisfying the above relationship, so as to adjust the ratio of the mean value DXREF' depending upon the specifications of the control system.

The mean value DXREF can also be calculated from the following equation:

$$DXREF = \frac{1}{B} \times \sum_{j=0}^{B} DAIn-j$$

wherein DAIn−j represents a value of the feedback mode control term DAIn obtained at a jth control action before the present one, and B a constant. According to the latter equation, calculation is made of the sum of the values of feedback mode control term DAIn from the control action taking place B times before the present control action to the present control action, each time a value of DAIn is obtained, and the mean value of these values DAIn forming the sum is calculated.

Reverting to FIG. 2, at the step 7, supplementary air is supplied to the engine in a quantity corresponding to the thus culculated valve opening duty ratio DOUT of the control valve 6, to thereby maintain the engine speed within the desired idling speed range defined by the upper limit value NH and the lower limit value NL.

During the idling speed feedback mode control, it can sometimes happen that the engine speed Ne temporalily rises above the upper limit value NH of the desired idling speed range due to a decrease in the engine load caused by external disturbances or extinction of electrical load on the engine. In such event, once the deceleration mode control is terminated and the feedback mode control is started, the control of the supplementary air quantity is continued in feedback mode even if the engine speed Ne temporaily rises above the upper limit value NH of the desired idling speed range, so long as the throttle valve 5 is substantially fully closed, to thereby achieve stable rotation of the engine. In this way, when the engine speed Ne temporaily rises above the upper limit value NH of the desired idling speed range, due to external disturbance or extinction of the electrical load on the engine, it is determined at the step 4 that the relationship of $Me \geqq MH$ is not satisfied, and the program proceeds to the step 5. At the step 5, it is determined whether or not the last control loop was executed in feedback mode, and if it was (that is, the answer is yes), then the program proceeds to the step 7, thereby continuing the execution of feedback mode control.

During idling of the engine under feedback mode control or under decelerating mode control, when the throttle valve 5 is opened, the supplementary air quantity is controlled in acceleration mode. That is, the answer to the question of the step 3 then becomes no, and the program proceeds to the step 8 to determine whether or not the valve opening period DOUTn−1 of the control valve 6 in the preceding loop was smaller than a predetermined value $D_0$ corresponding to a substantially fully closed position of the control valve 6. When the answer is no, the program proceeds to the step 9 to calculate the valve opening duty ratio DOUT for accelerating mode control.

This calculation of the valve opening duty ratio DOUT of the control valve 6 in accelerating mode is intended to gradualy decrease the quantity of supplementary air being supplied to the engine through the control valve 6 in synchronism with generation of TDC signal pulses, instead of abruptly interrupting the supply of supplementary air through the control valve 6, to thereby prevent a sudden drop in the engine speed and achieve smooth transition of the engine operation to acceleration, when the throttle valve 5 of the engine is opened.

Figure 6:
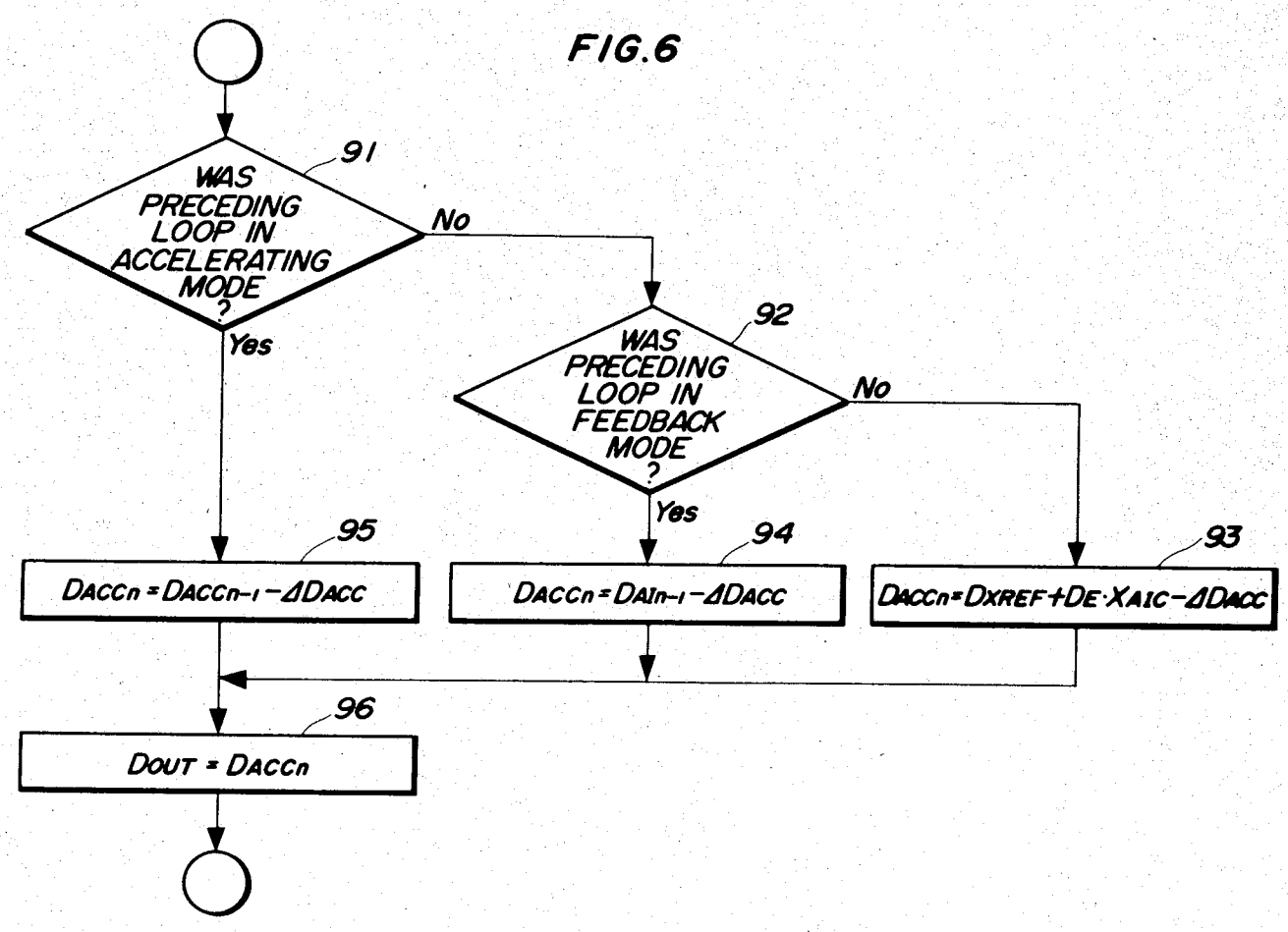
FIG. 6 is a flow chart showing a manner of calculating the valve opening duty ratio DOUT of the control valve applied during accelerating mode control of the supplementary air quantity.

FIG. 6 shows a manner of calculating the valve opening duty ratio DOUT for accelerating mode control, which is executed at the step 9 in FIG. 2. First, at the step 91 in FIG. 6, it is determined whether or not the preceding loop was executed in accelerating control mode. If the answer at the step 91 is no, the step 92 is executed to determine whether or not the preceding loop was in feedback control mode. If the answer at the step 92 is no, it means that the preceding loop was neither in accelerating control mode nor in feedback control mode, and it is assumed that decelerating mode control was effected in the preceding control loop. Then, the program proceeds to the step 93 wherein a value DACCn is determined by employing a value of the valve opening duty ratio DOUT obtained in the preceding loop, i.e. the duty ratio DOUT (=DXREF+DE·XAIC) calculated by the aforementioned equation (1) as an initial of the value DACCn, and subtracting a predetermined value ΔDACC from the initial value (i.e. DACCn=DXREF+DE·XAIC−ΔDACC).

On the other hand, if the answer at the step 92 is yes, it is assumed that the present loop is the first loop executed in accelerating control mode after feedback mode control, and the program proceeds to the step 94 wherein a value DACCn is determined by employing the integral control term DAIn−1 obtained in the preceding loop at the step 76 in FIG. 3 as an initial value of the value DACCn, and subtracting a predetermined value ΔDACC from the initial value (i.e. DACCn=DAIn−1 - ΔDACC).

If the answer at the step 91 is yes, that is, if the preceding loop was in accelerating control mode, a present value DACCn is determined by subtracting the predetermined value ΔDACC from a value DACCn−1 obtained in the preceding loop (i.e. DACCn=DACCn−1−ΔDACC).

Then, at the step 96, the valve opening duty ratio DOUT is set to the value DACCn obtained in the step 93, 94, or 95, followed by termination of execution of the program of FIG. 6.

The subtraction by the predetermined value ΔDACC is repeatedly executeded in accelerating mode control, and when the relationship of $DOUTn-1 \leqq D_0$ stands in the step 8 in FIG. 2, the valve opening duty ratio DOUT is set to zero as in the step 2, and the program is then terminated.

Although in the foregoing embodiment, the electrical load-dependent correction value DE was multiplied by the air increasing coefficient XAIC, for instance, to determine an initial value of the integral control term DAIn−1 applied at the start of feedback mode control, etc., this is not limitative, but the electrical load-dependent correction value DE may alternatively be added to the air increasing coefficient XAIC.

What is claimed is:

1. A method of controlling the operating amount of a control valve for regulating the quantity of intake air being supplied to an internal combustion engine, in a feedback manner responsive to the difference between a desired idling speed and an actual engine speed while said engine is in a predetermined idling region, said engine having a generator driven for supplying electric power to at least one electrical device in dependence upon the operative states of said electrical device, the method comprising the steps of: (1) detecting the value of a signal indicative of generating conditions of said generator; (2) determining a correction value for the operating amount of said control valve in dependence upon the value of said signal thus detected; (3) correcting the operating amount of said control valve by means of said correction value thus determined; and (4) setting an initial value of the operating amount of said control valve which is applied at the start of the feedback control to a sum of a value obtained by correcting said correction value by a predetermined increment, and a predetermined reference value, when said engine has entered said predetermined idling region immediately after deceleration thereof.

2. A method as claimed in claim 1, wherein said correction value is corrected by multiplying same by said predetermined increment.

3. A method as claimed in claim 1, wherein said correction value is corrected by adding same to said predetermined increment.

4. A method as claimed in claim 1, wherein said predetermined reference value is set to a mean value of values of the operating amount of said control valve which have been obtained during past feedback control.

5. A method as claimed in claim 1, wherein when said engine is in a predetermined decelerating region wherein it is decelerating toward said predetermined idling region, the operating amount of said control valve is set to a value equal to the initial value thereof applicable at the start of the feedback control, and said engine is supplied with intake air through said control valve in a quantity corresponding to the operating amount of said control valve thus set while said engine is in said predetermined decelerating region.

6. A method as claimed in claim 5, wherein said predetermined decelerating region of said engine is a region wherein the engine speed decreases from a predetermined value higher than said desired idling speed toward said desired idling speed.

7. A method as claimed in claim 1, wherein the value of said signal indicative of generating conditions of said generator is proportionate to the magnitude of field current supplied to said generator.

* * * * *